US006454049B1

(12) United States Patent
Dorsett

(10) Patent No.: US 6,454,049 B1
(45) Date of Patent: Sep. 24, 2002

(54) ELECTRIC LIFTING APPARATUS FOR USE WITH A LADDER

(76) Inventor: Dannie L. Dorsett, 621 New Stine Rd., Bakersfield, CA (US) 93309

( * ) Notice: Subject to any disclaimer, the term of this patent is extended or adjusted under 35 U.S.C. 154(b) by 0 days.

(21) Appl. No.: 09/653,576

(22) Filed: Aug. 31, 2000

Related U.S. Application Data

(60) Provisional application No. 60/151,339, filed on Aug. 30, 1999.

(51) Int. Cl.[7] ..... E06C 7/16

(52) U.S. Cl. ..... 182/129; 182/121; 182/102

(58) Field of Search ..... 182/101–103, 182/129, 121, 117

(56) References Cited

U.S. PATENT DOCUMENTS 4,128,228 A * 12/1978 Ziegelman ..... 182/101
5,427,356 A * 6/1995 Krotov ..... 182/129
5,647,452 A * 7/1997 Gauithier ..... 182/121

* cited by examiner

*Primary Examiner*—Alvin Chin-Shue

(57) ABSTRACT

A portable lifting apparatus, removably attached to a ladder, comprising an electrically powered winch mounted on a rigid frame having a pivotally attached brace.

11 Claims, 5 Drawing Sheets

ELECTRIC LIFTING APPARATUS FOR USE WITH A LADDER

CROSS REFERENCE TO A RELATED PATENT APPLICATION

This disclosure contains information that is common to Provisional Patent Application Ser. No. 60/151,339 filed Aug. 30, 1999.

FIELD OF THE INVENTION

This invention relates generally to lifting devices for use on a temporary basis to lift heavy things up to, or to lower them down from, an elevated height—in particular the roof of a building; more specifically, it relates to an attachment for a sturdy ladder in order to take advantage of the structural strength of the ladder.

BACKGROUND OF THE INVENTION

There are many instances in which a relatively heavy load must be raised from the ground to an elevated height, such as the roof of a building. For example, an air conditioning repair man may need to raise a new compressor to the top of a building—to replace one that has worn out. Similarly, the worn-out compressor must later be safely lowered to the ground, without posing a risk to anyone or any thing at ground level. A compressor rated at three tons of cooling capacity will often weigh about 50 pounds, and a five ton compressor will often weigh about 100 to 150 pounds. Another heavy thing that is often raised to the top of a building is roofing material that can be both heavy and bulky.

When an air-conditioning service man goes out on a service call, he often goes alone, because initially he doesn't know whether the problem is likely to be a simple thing to fix—like resetting a circuit breaker, or a more complicated thing—like replacing a compresssor. If he normally works alone, and he discovers only after arriving at a job site that heavy lifting will be required, he may have to call for assistance—because he needs muscular help to lift a heavy compressor to the elevated height of a roof-mounted system. Waiting for an assistant to arrive can be wasteful of time on the part of the service man, and it can also be frustrating to the customer. On a hot day, a client normally wants cool air restored—not an explanation as to why the job will have to be completed tomorrow instead of today.

This kind of a problem is not new, of course, and efforts have been made to solve the problem. One proposed solution is found in U.S. Pat. No. 5,139,108 to Pate entitled "Stabilized Ladder Power Winch System," in which a winch is affixed to a ladder near the bottom of the ladder; a long cable is used to extend from the low winch all the way to the top of the ladder, over a pully and then back down to the load that is to be raised. Although it does not appear in the Pate drawings, there will of necessity be two people in a work crew using a Pate apparatus. That is, there must be one person standing on the ground and controlling the winch, and another person on the roof guiding the load as it is lifted to the point where it reaches the roof. U.S. Pat. No. 4,598,795 to Larson entitled "Ladder Hoist Attachment" avoids the two-man problem faced by Pate by placing a hand-cranked winch at the top of the ladder, so that a single worker could presumably get a heavy load to the roof and control it once the load had arrived. However, a hand-cranked winch will require that the worker use a crank in the manner in which all cranks are used. This means that circular movement of the crank will cause the worker to be pushing out on the crank (and the attached ladder) during half of a cycle, and pulling in on the crank (and the attached ladder) during the other half of a full cycle. This alternate pushing out and pulling in on the ladder is not conducive to control of either a stable ladder or a heavy load that is suspended from the top of the ladder by a long cable. Indeed, the oscillatory movement of the crank can result in oscillations that are imparted to the load, with the result that the load can begin to swing to and fro from a long cable that extends to the roof.

Another deficiency of all of the aforementioned devices is that they are adapted to work only at the periphery of a building, i.e., where the foot of a ladder is resting on the ground—spaced from but fairly close to the edge of a building. There is no teaching in any of the patents as to how their respective devices might be used in the middle of a building with a flat roof, when a roof-access opening is located near an elevator shaft and an interior elevator has been used to get a heavy load to the top floor of a building. What remains is the problem of getting the load from the building's top floor onto the roof, and the only travel path is through a central opening in the roof. It is an object of this invention to provide an apparatus that can be used either at the periphery of a building or at an interior position where there is an access opening in the roof.

In brief, the invention includes a structural frame that is adapted to be temporarily affixed to a heavy-duty ladder. An ordinary definition of the word "ladder" is a rigid structure, often portable, consisting of two long "side" members connected by a series of spaced and parallel rungs or steps; the rungs or steps are usually about 18 to 24 inches long. For the purposes of this disclosure, ladders can be further identified as being of three principal types. One type is generally straight or linear, like a ladder of fixed length or an extension ladder; such ladders are not inherently stable when they are erect, and it is expected that they will be connected to or lean against something for at least a part of their vertical stability. As seen from the side of a ladder in a working position, a straight ladder and the wall against which it is leaning will have the general shape of a letter A that is leaning significantly to one side—like the Tower of Pisa.

A second type of ladder has two pairs of legs of essentially equal length; one pair of legs is usually pivoted to the other pair at the ladder's top. Such ladders are normally self supporting, in the sense that they don't have to lean against a wall or the like to be usable. An example of the second type of ladder is commonly called a step ladder, and it resembles the letter "A" in a symmetrical form when seen from the side. Step ladders usually have narrow steps instead of rungs for supporting a person's feet, and they are usually shorter than straight ladders.

The third kind of ladder is articulated or folding, sometimes called a multipurpose ladder; it may be configured into a variety of different shapes, depending upon the requirements of the user and the environment in which it will be used. For example, an articulated ladder may be configured as an inverted "U" or a scaffold, and used by a house painter to straddle a hedge that is growing immediately next to a house. This invention is usable with all of these ladders.

BRIEF DESCRIPTION OF THE INVENTION

A major part of the invention ia a structural frame that functions as a platform that is designed to be placed with a generally horizontal orientation somewhere near the top of a ladder. In one mode of use, the structural frame functions as a long handle that is used to push a straight ladder away from the edge of a roof—on a temporary basis, so that a load can be lifted onto the roof. Another important structural piece is a brace that preferably is foldable so that it may be made to lie in the same general plane of the platform—during transportation and storage; this configuration will sometimes be referred to aptly as its "flat" or storage configuration. The brace can also be unfolded for use in stablizing the platform when a straight ladder is generally upright and leaning against the side of a building, etc. When the platform is being held with a generally horizontal orientation, its rearward end will be engaged with one rung of the ladder. The brace will extend downwardly at an angle with respect to the platform, to make load-bearing contact with and "engage" a different rung of the ladder at a lower elevation.

Mounted on and carried by the structural frame is an electrically powered winch which is selectively actuated to raise or lower a heavy-duty cable and any load to which the cable is attached. Actuation of the winch is preferably accomplished with a rocker-type switch that is located at the forward end of the structural frame. The preferred switch may also be described as a double pole, normally OFF, momentarily ON switch, in that the winch's motor is actuated for only as long as the switch is depressed, whether a load is being raised or lowered.

When in its flat mode, the lifting apparatus can be carried up a straight ladder by a worker, who then connects it to the ladder when he (or she) has reached the roof and climbed onto it. The lifting apparatus (including a winch and cable, etc.) is expected to weigh about 30 pounds when the structural parts are made of aluminum tubing, and this is a weight that a healthy worker is expected to be able to handle without difficulty. When the lifting apparatus has been carried to the roof, it is easily attached to an upper part of the ladder, and the cable is ready to be played out until sufficient length to reach the ground has been obtained. A hook at the distal end of the cable is then connected to a load on the ground. When a source of electrical power, usually 110 volt AC power, has been connected to the winch, the load is ready to be lifted toward the roof. Any needed clearance between the generally vertical cable and the edge of the roof can be realized by manually pushing the top of the ladder away from the roof for a foot or so.

When the load rises to the point that it is almost at the roof, the ladder may need to be pushed outward for another few inches—to ensure that there is clearance for the load. Once the load is at an elevation above the roof, the ladder may be allowed to lean inward until it again contacts the edge of the roof, and the load may then be lowered to the roof.

Alternatively, a load may be brought to a building's roof by pulling it upward through a roof-access opening in the interior of the roof. Such openings in roofs are often closed by skylights at most times, but they can be opened to provide access to the roof for workers. A step ladder, or two step ladders, can be erected adjacent the opening, and the lifting apparatus can be installed in its flat mode—between two structural members on the ladder(s) that are at about the same height. The winch's cable can then be lowered through the access hole and connected to a load (inside the building) that is to be brought up to the roof. Of course, the ladders that are selected for use with this invention should be sturdy enough to carry the loads that may need to be lifted to (or lowered from) a roof. The preferred winch has a load rating of at least 200 pounds, so any ladder that is used with the invention should be rated to carry a similar load.

Another advantageous feature of the invention is a safety device that prevents the structural frame from becoming accidentally separated from the ladder during use. This is important because it is not a goal of the invention to build a cousin or other close relative of the Eiffel Tower; rather it is a goal to safely lift a load to and from an elevated height, even if only one person is available to do the lifting. Hence, a quick and easy set-up of the apparatus is important, but speed must not compromise safety. With this apparatus the initial step of connecting the frame to the ladder is done by simply letting a C-shaped structural member descend over an upper rung of a ladder. Next, a safety pin is inserted into two prepared holes near the outer edges of the C-shaped member, thereby capturing the ladder's rung and holding it until the pin is manually removed. This prevents the accidental separation of the frame and the ladder until all lifting has been completed.

BRIEF DESCRIPTION OF THE SEVERAL FIGURES OF THE DRAWING

Figure 11:
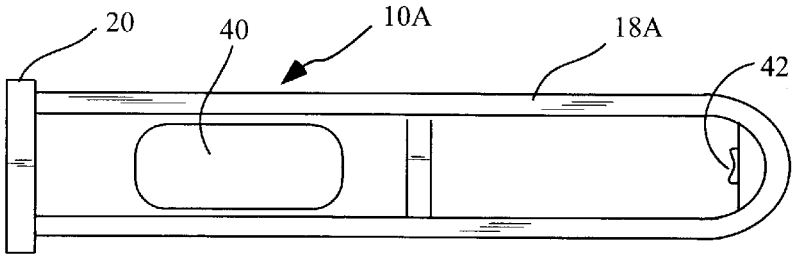
FIG. 11 is a top plan view of another embodiment of the lifting apparatus in which the brace is composed of two telescoping tubular elements, this embodiment being more compact than the embodiment of FIG. 5.
Figure 12:
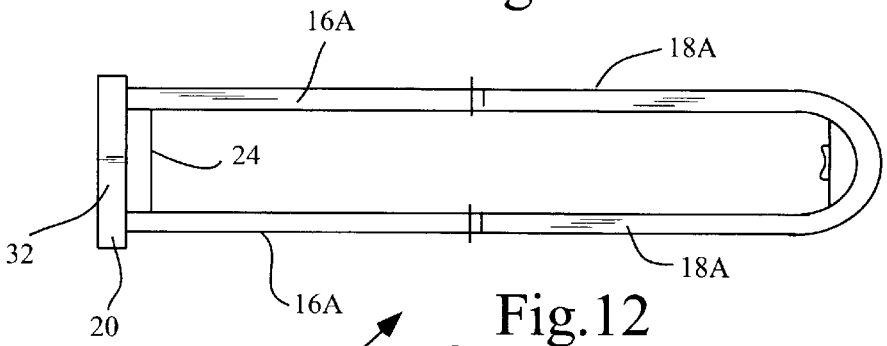
Figure 13:
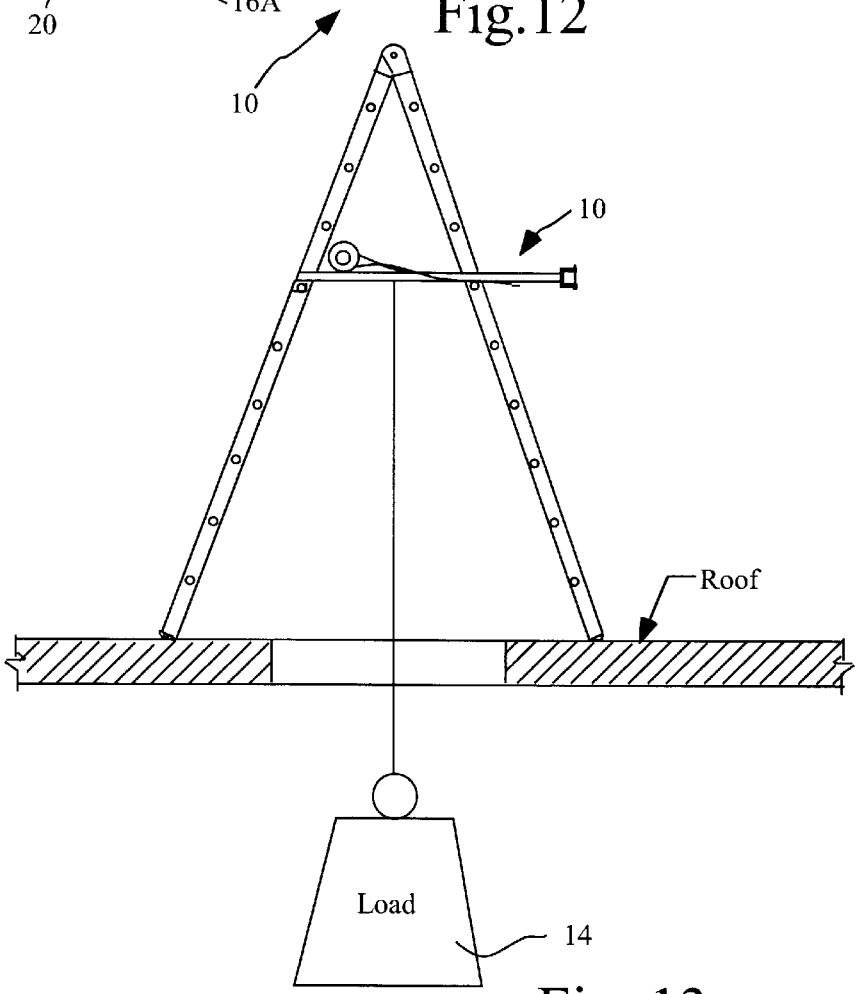

FIG. 12 is a bottom plan view of the lifting apparatus shown in FIG. 11, and clearly showing the brace in its stored position—where it lies generally parallel to the frame; and FIG. 13 is a schematic elevation view of a lifting apparatus in use on the roof of a building, where a load is to be moved through an "interior" opening in the roof, and wherein the apparatus is combined with an A-frame ladder instead of a straight ladder.

DETAILED DESCRIPTION OF A PREFERRED EMBODIMENT OF THE INVENTION

To perhaps simplify the description that will follow, the apparatus 10 will be said to have a first configuration in which it is to be attached to a straight ladder 12 that is leaning against a building. This first configuration will be referred to as its SL configuration, with the two letters being an abbreviation for "straight ladder". FIGS. 1–4 illustrate the environment in which the apparatus 10 can be used, and show—sequentially—the porcess of manually getting the apparatus 10 to the top of a ladder, connecting it to the ladder, raising a load 14 to the roof of a building, and depositing the load on the roof. In this configuration a brace 16 is folded downwardly with respect to a structural frame 18 when the frame is generally horizontal—as it would be when it is being used adjacent the roof of a building.

Figure 1:
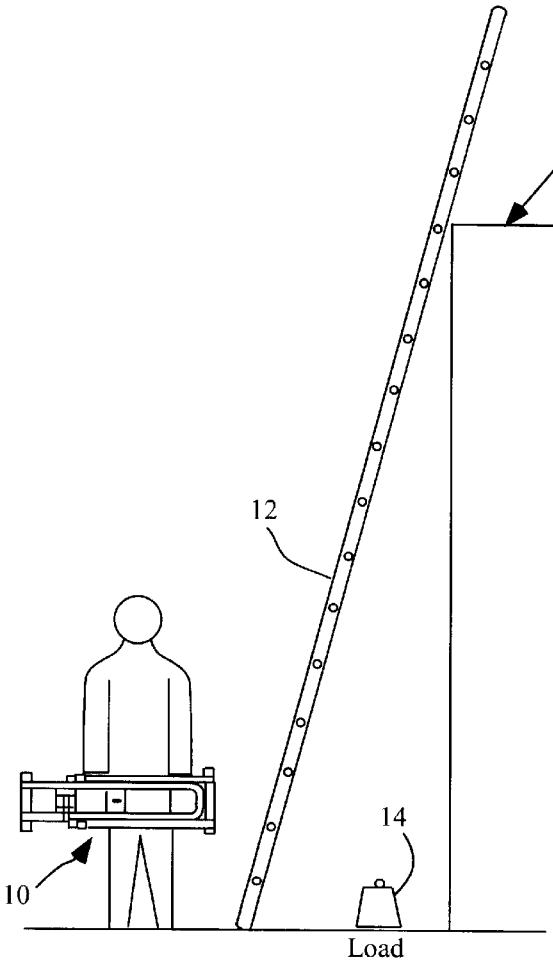
FIG. 1 is a pictorial showing of a building, a straight ladder that will reach the roof of the building, a load that is to be raised to the roof, and the single worker who can use the invention described herein to get the load to the roof.

Referring in greater detail to FIG. 1, the ladder 12 is placed adjacent the building with a generally upright orientation, with its lower end in contact with the ground—a few feet from the vertical wall of a building, so that the ladder will be stable when it leans against the top of the building. A worker on the ground is shown holding the apparatus 10 by grabbing the frame 18 and lifting it. It is believed that most workmen who would have any interest in using the apparatus 10 would be able to climb the ladder while holding the apparatus 10 in one hand. When the frame 18 is made of tubular aluminum, it should be relatively light;, and even with a winch and cable attached, it should weigh no more than about 30 pounds. But for those who have less confidence in their physical abilities, it would be simple enough to tie a rope onto the apparatus 10 and pull it up to the roof, after the worker climbs the ladder with both hands free. Once on the roof the worker would then release the pin that holds the brace 16 in its stored position, so that the brace can be rotated downward where it may placed in contact with a low rung. Next, the open C-shaped channel at the rearward end of the frame is moved vertically and placed over an upper rung of the ladder. (This open channel will be better seen in FIG. 5.) A locking pin that is inserted through two aligned holes in the C-shaped channel will hold the frame 18 to the ladder 12, so that these two major pieces cannot be accidentally separated. By slightly rotating the frame 18 by a few degrees with respect to the ladder 12, and gently pushing outward on the distal end of brace 16, a C-shaped channel at the bottom of the brace can be brought into alignment with a low rung. Allowing the frame to rotate downward by a small amount will then cause the brace's C-shaped channel to envelop the low rung and, after movement of a couple of inches, come into load-bearing contact with the low rung. With such a "slip-on" engagement, there is no requirement for nuts, bolts, or other time-consuming fasteners; and a load with a significant vertical component on the brace will further ensure that the brace stays in contact with the ladder. But as with the generally horizontal frame 18, a simple pin inserted through two confronting holes can be used to more dependably secure the distal end of the brace 16 to the ladder.

Figure 2:
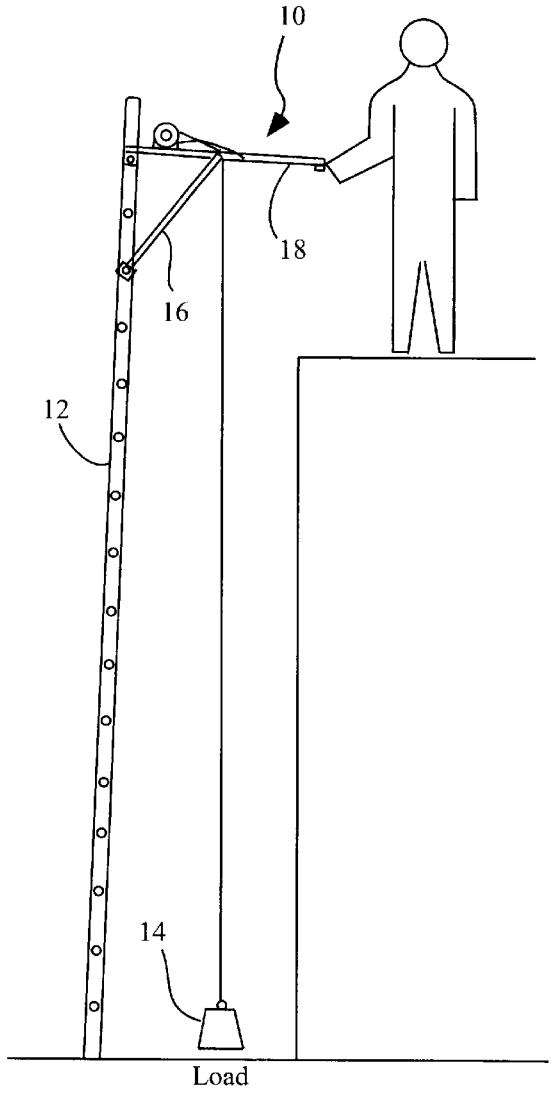
FIGS. 2–4 show the elements of FIG. 1 as the load is sequentially connected to the winch, raised to above the roof level, moved horizontally (inwardly) so that it is over the roof, and then lowered to a position on the roof.
Figure 3:
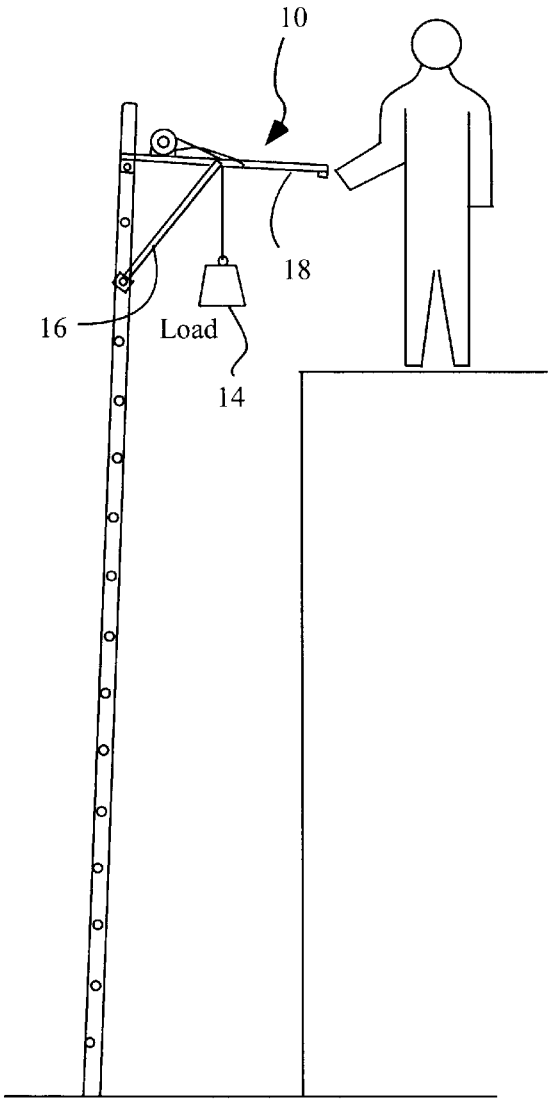
Figure 4:
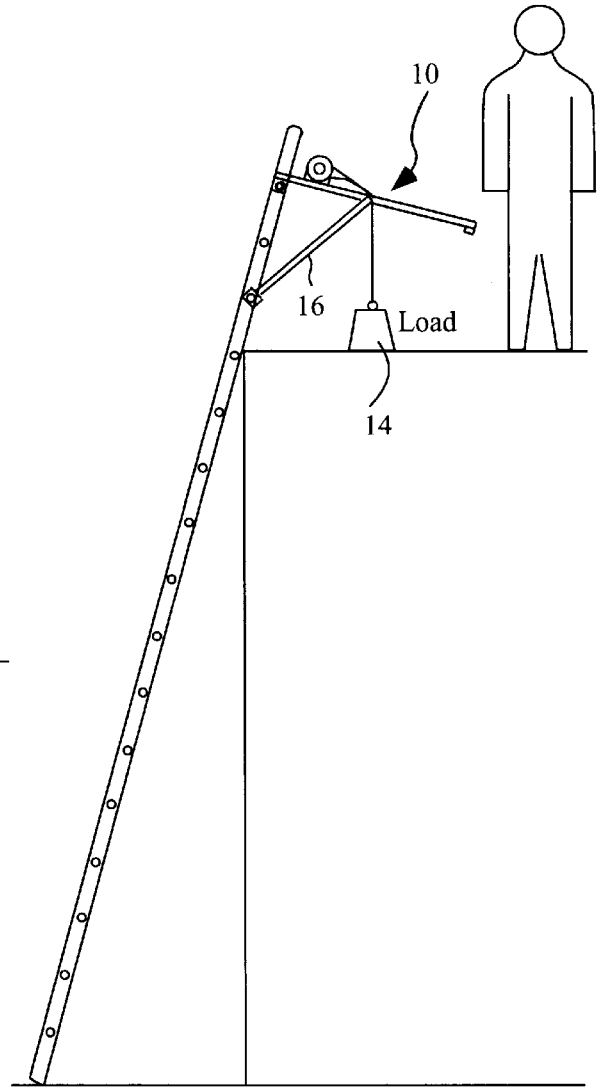

Turning next to FIG. 2, an installed apparatus 10 has been used to move the top of the ladder outwardly for a small distance, horizontally away from the building, to provide ample room for the load to be freely lifted with respect to the building. Because of the relative positions of the ladder 12 and the load 14, the ladder is still stable, and there is no risk that it will fall away from the building. FIG. 3 shows the load after it has been lifted high enough to clear the roofs edges and FIG. 4 shows the load after it has been lowered to the roofs upper surface.

Figure 5:
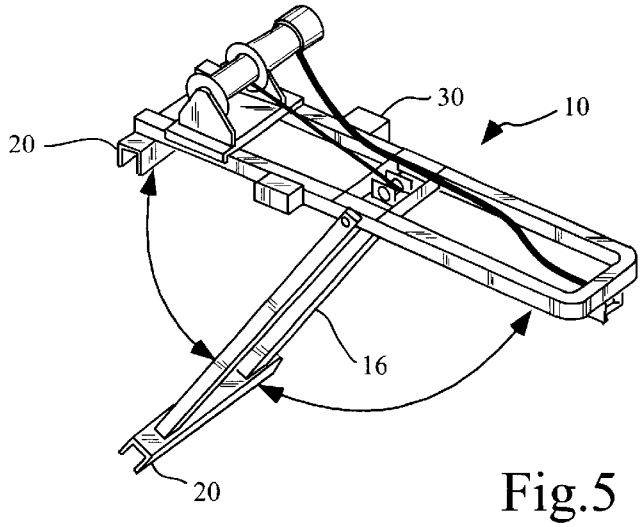
FIG. 5 is a perspective view of one embodiment of the lifting apparatus, similar to the apparatus shown in FIG. 1.
Figure 6:
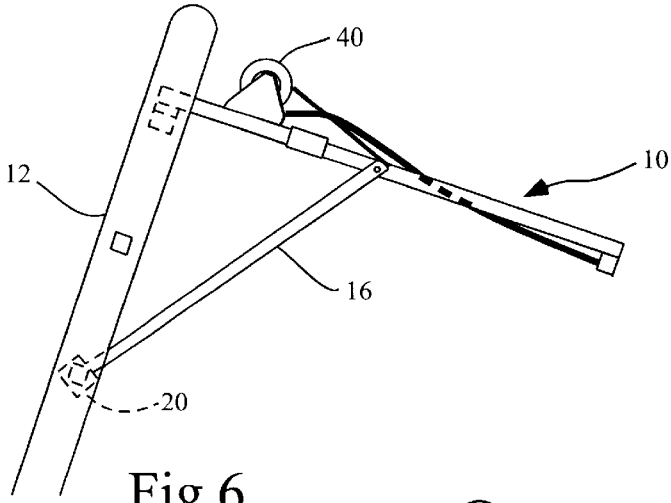
FIG. 6 is a side elevation view of the lifting apparatus shown in FIG. 5, showing the apparatus engaged with two rungs of an exemplary ladder.

FIG. 5 shows a perspective view of an apparatus 10 without the ladder to which it would be attached. This figure also shows the brace 16 folded downward (with respect to the frame 18) at an angle to engage a low rung on a ladder. When the brace has a length of about 30 inches, the brace will typically engage the second rung below the frame while keeping the frame near a horizontal orientation. Also clearly shown is the C-shaped channel 20 that is sized and configured for enveloping a rung of the ladder. Actual engagement of the channel 20 and a rung is shown in FIG. 6. Also shown in FIG. 6 is a pin 22 that passes through two aligned holes in channel 20, for the purpose of capturing the enveloped rung—and ensuring that the frame 18 and the ladder 12 cannot be accidentally separated. In this sense, the pin 22 may be described as a locking device, although it is still possible to achieve modest rotational movement of the frame with respect to the ladder, even when they cannot be separated.

Figure 7:
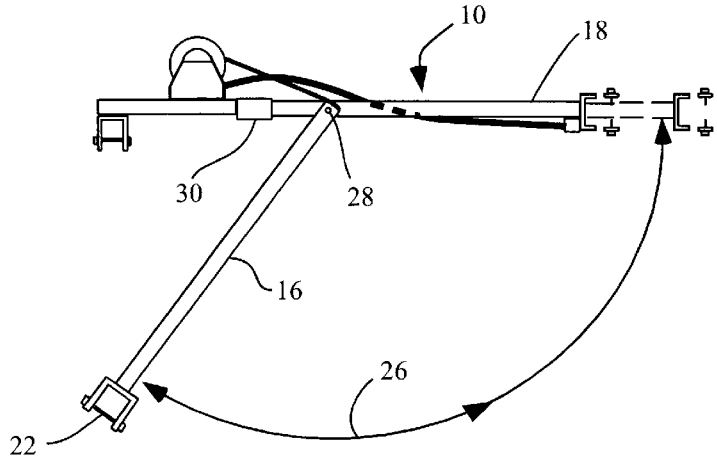
FIG. 7 is a side elevation view of the lifting apparatus shown in FIG. 6, illustrating how the brace can be folded to a collapsed position (where it is essentially parallel to the frame) to make the apparatus more compact and make it easier to carry.

FIG. 6 also shows that the C-shaped channel 20 opens at an angle that is 90 degrees with respect to the plane of the frame, while the C-shaped channel 24 opens in the plane defined by the brace 16. These angles have been chosen to facilitate the step of engaging the lifting apparatus with a ladder. In FIG. 7 the openings of both of these C-shaped channels 20, 24 are shown as being "closed" with locking pins, although such pins would normally be installed only when a ladder's rung has been captured within a respective channel. FIG. 7 also shows, with arrow 26, the step of rotating the brace 16 toward its storage position, i.e., a position where the brace is generally parallel to the frame 18. When two pivot pins for the brace, represented by the axis of rotation 28, are removed, the brace may be moved a few inches toward the rearward end of the frame—until they enter into two sleeves 30 that are permanently fixed to the frame. The broken-line showing of the brace 16 at the right of FIG. 7 indicates its folded position, and the solid showing of the brace indicates its captured position.

Figure 8:
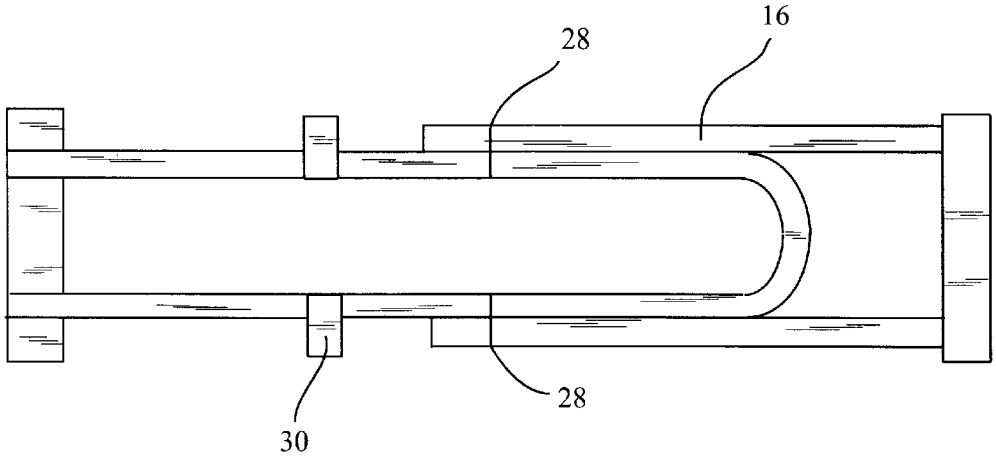
FIG. 8 is a top plan view of one embodiment of a frame for a lifting apparatus, shown without the winch which would be rigidly connected to such a frame.
Figure 9:
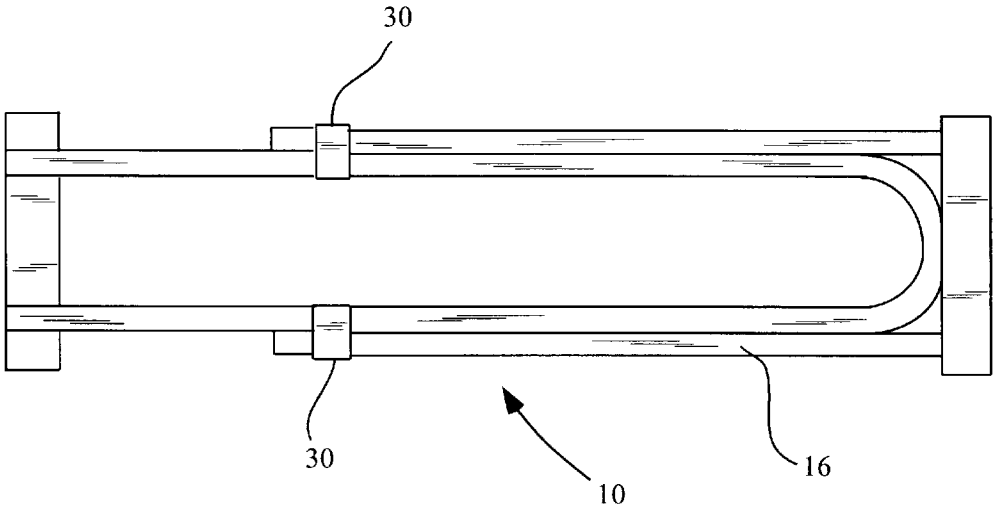
FIG. 9 is a top plan view similar to FIG. 8, but with the brace moved into a position where two sleeves on the frame have enveloped the free ends of the brace.

FIG. 8 is a top plan view of the frame 18 and the folding brace 16, with both of these elements being moved so that they lie in essentially the same plane. The brace 16 is shown in a position equivalent to that of the broken-line showing of the brace in FIG. 7. FIG. 9 shows the frame 18 and the brace 16 with the brace moved so that its two ends are captured by the sleeves 30.

Figure 10:
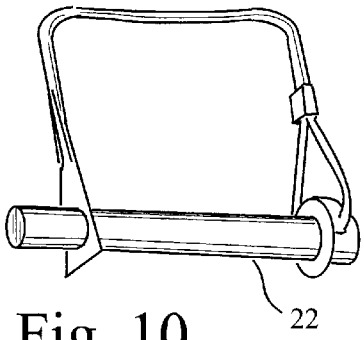
FIG. 10 is a perspective view of an exemplary pin of the type that can be used to secure a frame and/or a brace to the rung of a ladder.

FIG. 10 is a perspective view of a exemplary pin 32 that can be used to hold a ladder's rung within a C-shaped channel.

FIG. 11 is a top plan view of the preferred embodiment of the invention, wherein the brace 16A consist of two telescoping aluminum tubes, with the tubes having a nominal size of about 1.25 inches to 1.5 inches. Tubing with a square cross section, and having a wall thickness of about ⅛ inch has been found to have a good weight-to-strength ratio for this apparatus. The winch 40 shown on top of the frame is preferably selected to be as good as a SA5000AC winch made and sold by Dutton-Lainson Company of Hastings, Nebr. That particular winch is operated by 110 volt AC power, and is sold under the StrongArm trademark to the marine and trailer industry. However, for special purposes, a 12-volt DC winch motor could be utilized, which might be the case if someone had fallen into a well in a remote location—and needed to be rescued. Braided steel wire cable having a nominal diameter of about ⅛ inch has been found to be suitable for lifting all of the loads that this apparatus is likely to be used with. The switch 42 to operate the winch is preferably a rocker switch that—electrically—is a double pole, normally OFF, momentarily ON switch. By locating the switch 42 on the inside of the frame 18A near its forward end, the switch can be operated by one finger without requiring an operator to let go of the forward end of the frame. Hence, horizontal positioning of the frame 18A and any load that is being raised or lowered can be managed by a single operator while he or she is simultaneously controlling the load's up and down movement.

FIG. 12 shows a bottom plan view of the preferred embodiment 10A, with the brace 16A being shown in its telescoped mode. A pin inserted through a hole in the C-shaped channel on the frame 18A prevents the brace 16A from "unfolding" with respect to the frame, so the brace is captured until someone deliberately unlatches it. In all other respects the apparatus 10A is used in the same manner as the earlier described embodiment.

A distinct advantage of the lifting apparatus disclosed herein is that it can be made into a generally planar structure (except for the winch) as seen from the side, so that it may be placed in the manner of a bridge between two spaced but same-level supports. Hence, an A-frame ladder (as suggested in FIG. 13) can be used to support the apparatus in a generally horizontal mode while the winch is being used to raise or lower a load. So when a roof-access hole is available in the interior of a roof, an apparatus in accordance with this invention can be used either at the edge of a roof or at the roofs interior.

While only two principal embodiments of the invention have been disclosed herein, those skilled in the art will recognize that minor variations in the inventive concept might be made—without departing from the broad ideas that have been revealed. Hence, the invention should be considered to be limited only by the scope of the claims appended hereto.

What is claimed is:

1. A portable lifting apparatus adapted to be used with a ladder and manually positioned at an elevated position above ground level for the purpose of selectively moving a given load between a low position and an elevated position, comprising:

(a) a rigid frame adapted to be manually placed with a generally horizontal orientation at an elevated location with respect to the ground, and the frame having forward and rearward ends;

(b) an electrically powered winch that is rigidly connected to the rigid frame, said winch having a rotatable drum and a cable with proximate and distal ends, the cable's proximate end being connected to the drum for rotation therewith, and the distal end of the cable being configured for selective connection to the given load for supporting the same;

(c) a source of electrical power connected to the winch;

(d) a manually actuated switch that is wired to control actuation of the switch;

(e) a ladder having rungs; and (f) a brace comprising a rung engaging means and a pair of legs extending therefrom, a pair of selectively removable pin pivotally connecting the legs of said brace to the frame, said frame having a pair of sleeves attached thereto, the brace having a stored position generally parallel to the frame wherein selectively removable pins are removed from pivotally connecting said legs to the frame and said pair of legs are slideably received in said sleeves and a downward position in which the brace extends downwardly at an angle with respect to the frame and the brace engages a rung of the ladder.

2. The protable apparatus as claimed in claim 1 wherein the switch is a double pole, normally OFF, momentarily ON switch, and the switch is wired so that it can be used to both raise and lower the load with respect to the frame.

3. The portable lifting apparatus as claimed in claim 1 wherein the frame has a length between its forward and rearward ends of about four feet and a width of about one foot.

4. The portable lifting apparatus as claimed in claim 1 wherein the frame encompasses an area of about 4 square feet, and wherein the combined weight of the frame and the winch and a cable of 30 feet is about 30 pounds, whereby said combined weight of about 30 pounds is within the range of weights that are considered as routinely transportable by healthy workmen.

5. The portable lifting apparatus as claimed in claim 1 and further including means for selectively locking the frame to the ladder in such a way that they cannot be accidentally separated during use.

6. The portable lifting apparatus as claimed in claim 1 wherein said switch is located on the forward end on the frame where it can be selectively actuated by an operator's finger on one hand while the operator is simultaneously gripping the forward end of the frame with the same hand, whereby the operator's second hand remains free for accomplishing any necessary adjustment that may be necessary with regard to positioning the load in a horizontal plane.

7. The portable lifting apparatus as claimed in claim 1 wherein the frame has at its rearward end a rigid C-shaped channel that is sized and configured for enveloping a rung of the ladder, whereby connection of the frame to the ladder is facilitated.

8. A portable lifting apparatus adapted to be used with a ladder and manually positioned at an elevated position above ground level for the purpose of selectively moving a given load between a low position and an elevated position, comprising:

(a) a rigid frame adapted to be manually placed with a generally horizontal orientation at an elevated location with respect to the ground, and the frame having forward and rearward ends, wherein the frame is primarily made of tubular aluminum material;

(b) an electrically powered winch that is rigidly connected to the rigid frame, said winch having a rotatable drum and a cable with proximate and distal ends, the cable's proximate end being connected to the drum for rotation therewith, and the distal end of the cable being configured for selective connection to the given load for supporting the same;

(c) a source of electrical power connected to the winch;

(d) a manually actuated switch that is wired to control actuation of the switch;

(e) a ladder having rungs; and (f) a brace comprising a rung engaging means and a pair of legs extending therefrom, a pair of selectively removable pin pivotally connecting the legs of said brace to the frame, said frame having a pair of sleeves attached thereto, the brace having a stored position generally parallel to the frame wherein selectively removable pins are removed from pivotally connecting said legs to the frame and said pair of legs are slideably received in said sleeves and a downward position in which the brace extends downwardly at an angle with respect to the frame and the brace engages a rung of the ladder.

9. The portable apparatus as claimed in claim 8 wherein the tubular aluminum material has a nominal thickness of about ⅛ inch.

10. The portable apparatus as claimed in claim 8 wherein the tubular aluminum material has a transverse cross section that is generally square, wherein the sides of the square have a length of about 1.5 inches.

11. A portable lifting apparatus adapted to be used with a ladder and manually positioned at an elevated position above ground level for the purpose of selectively moving a given load between a low position and an elevated position, comprising:

(a) a rigid frame adapted to be manually placed with a generally horizontal orientation at an elevated location with respect to the ground, and the frame having forward and rearward ends, wherein the frame is primarily made of tubular aluminum material;

(b) an electrically powered winch that is rigidly connected to the rigid frame, said winch having a rotatable drum and a cable with proximate and distal ends, the cable's proximate end being connected to the drum for rotation therewith, and the distal end of the cable being configured for selective connection to the given load for supporting the same;

(c) a source of electrical power connected to the winch;

(d) a manually actuated switch that is wired to control actuation of the switch wherein the switch is a double pole, normally OFF, momentarily ON switch, and the switch is wired so that it can be used to both raise and lower the load with respect to the frame, wherein said switch is located on the forward end on the frame where it can be selectively actuated by an operator's finger on one hand while the operator is simultaneously gripping the forward end of the frame with the same hand;

(e) a ladder having rungs;

(f) a brace comprising a rung engaging means and a pair of legs extending therefrom, a pair of selectively removable pin pivotally connecting the legs of said brace to the frame, said frame having a pair of sleeves attached thereto, the brace having a stored position generally parallel to the frame wherein selectively removable pins are removed from pivotally connecting said legs to the frame and said pair of legs are slideably received in said sleeves and a downward position in which the brace extends downwardly at an angle with respect to the frame and the brace engages a rung of the ladder;

(g) wherein the frame has a length between its forward and rearward ends of about four feet and a width of about one foot;

(h) wherein the frame encompasses an area of about 4 square feet, and wherein the combined weight of the frame and the winch and a cable of 30 feet is about 30 pounds;

(i) wherein said selectively removable pins securely holding the brace in its stored position;

(j) wherein the frame is primarily made of tubular aluminum material having a nominal thickness of about ⅛ inch;

(k) wherein the tubular aluminum material has a transverse cross section that is generally square, wherein the sides of the square have a length of about 1.5 inches;

(l) wherein the apparatus includes means for selectively locking the frame to the ladder in such a way that they cannot be accidentally separated during use;

(m) wherein the frame has at its rearward end a rigid C-shaped channel that is sized and configured for enveloping a rung of the ladder; and (n) said brace rung engaging means comprises a rigid C-shaped channel that is sized and configured for enveloping a rung of the ladder.

* * * * *